US006095524A

United States Patent [19]

Richter et al.

[11] Patent Number: 6,095,524

[45] **Date of Patent: *Aug. 1, 2000**

[54] BINGO TABLE TOP

[76] Inventors: Sherri L. Richter; Coleen Feagans, both of 807 N. Indiana, Montrose, Mo. 64770

[ * ] Notice: This patent issued on a continued prosecution application filed under 37 CFR 1.53(d), and is subject to the twenty year patent term provisions of 35 U.S.C. 154(a)(2).

[21] Appl. No.: 08/815,922

[22] Filed: Mar. 13, 1997

[51] Int. Cl.[7] ..... A63F 3/06

[52] U.S. Cl. ..... 273/269; 273/148 A; 273/309

[58] Field of Search ..... 273/269, 150, 273/151, 148 A, 309; 206/315.1; 248/461

[56] References Cited

U.S. PATENT DOCUMENTS

| | | | |
|---|---|---|---|
| 1,716,022 | 6/1929 | Baker | 273/150 |
| 2,394,866 | 2/1946 | McClune | 273/148 A |
| 4,312,507 | 1/1982 | Smith et al. | 273/309 |
| 4,795,162 | 1/1989 | Rhetts | 273/309 |
| 4,948,139 | 8/1990 | Heeszel | 273/148 A |
| 5,152,490 | 10/1992 | Deutsch | 40/341 |
| 5,286,025 | 2/1994 | Mulyca et al. | 273/148 R |
| 5,324,036 | 6/1994 | Morrow | 273/148 R |
| 5,456,474 | 10/1995 | Geshkewich | 273/148 R |
| 5,495,947 | 3/1996 | Zarske | 273/148 R |

*Primary Examiner*—William M. Pierce
*Attorney, Agent, or Firm*—Kenneth L. Tolar

[57] ABSTRACT

A table top having several playing stations each with a card holder that can be separately oriented and fixed at a desired angular orientation relative to the table top's main planar surface. Fasteners on each holder permit one or more playing cards, such as bingo cards, to be held while they may be looked at and marked upon by a player. Rigid side card holder support legs engage lower spaced stops in an indentation in each playing station within the main planar surface to permit the holders to be oriented and fixed at the different angles.

12 Claims, 2 Drawing Sheets

BINGO TABLE TOP

BACKGROUND OF THE INVENTION

Anyone who has ever played the game of bingo knows that avid players have several cards in front of them at a time. When the the caller indicates a specific number and letter, the player looks over his or her several cards—and places a mark or marker on the space called on a given card if the space appears. If the player is the first to complete a row, column or diagonal spaces with called spaces they are the winner and call out bingo! A prize is usually awarded to the winner.

As players concentrate on filling their card spaces with called letters/numbers over a prolonged period of time, there is a certain amount of back and neck strain and pain as well as accompanying eye strain. One reason these occur is the physical orientation and location of the bingo cards relative to the position of the individual player's back and eyes. In many such cases the player is seated and stooped over looking down at the bingo card (s) lying flat on a table in front of them. The present invention seeks to alleviate back and neck strain and pain as well as eye strain while playing the game of bingo by permitting each player to individually orient his or her playing card holders relative to the main table top playing surface as desired. The device includes, a top holder capable of holding one or a plurality of bingo cards, the holder being adjustable to a plurality of different angular orientations as described herein.

DESCRIPTION OF THE PRIOR ART

The prior art is replete with table tops and card holders. For example, in U.S. Pat. No. 5, 5,286,025 to Mulyca et al. transparent webs are disclosed having bingo cards between them which can be marked through them. In U.S. Pat. No. 5,324,036 to Morrow a video game console with an inclined top and hinged panels is disclosed which allows the users access to the interior of the console. Another patent, U.S. Pat. No. 5,456,474 to Geshkewich, discloses a bingo card holder with an adhesive layer to hold the cards and a transparent cover. And in U.S. Pat. No. 5,495,947 to Zarske a bingo box is disclosed with angled panels which have spring clamps for holding bingo cards. The present invention differs from this and the known prior art by providing for a table top having several independently adjustable card holders as more further set forth in this specification.

SUMMARY OF THE INVENTION

This invention relates to a table top having several card holders each of which can be separately oriented at a desired angular orientation relative to the table top's main planar portion. Fasteners on each holder permit playing cards, such as bingo cards, to be held while they may be looked at and marked upon.

It is the primary object of the present invention to provide for an improved apparatus table top for a card game.

Another object is to provide for a table top specifically designed to hold and orient bingo playing cards.

These and other objects and advantages of the present invention will become apparent to readers from a consideration of the ensuing description and the accompanying drawings.

DESCRIPTION OF THE PREFERRED EMBODIMENT

Figure 1:
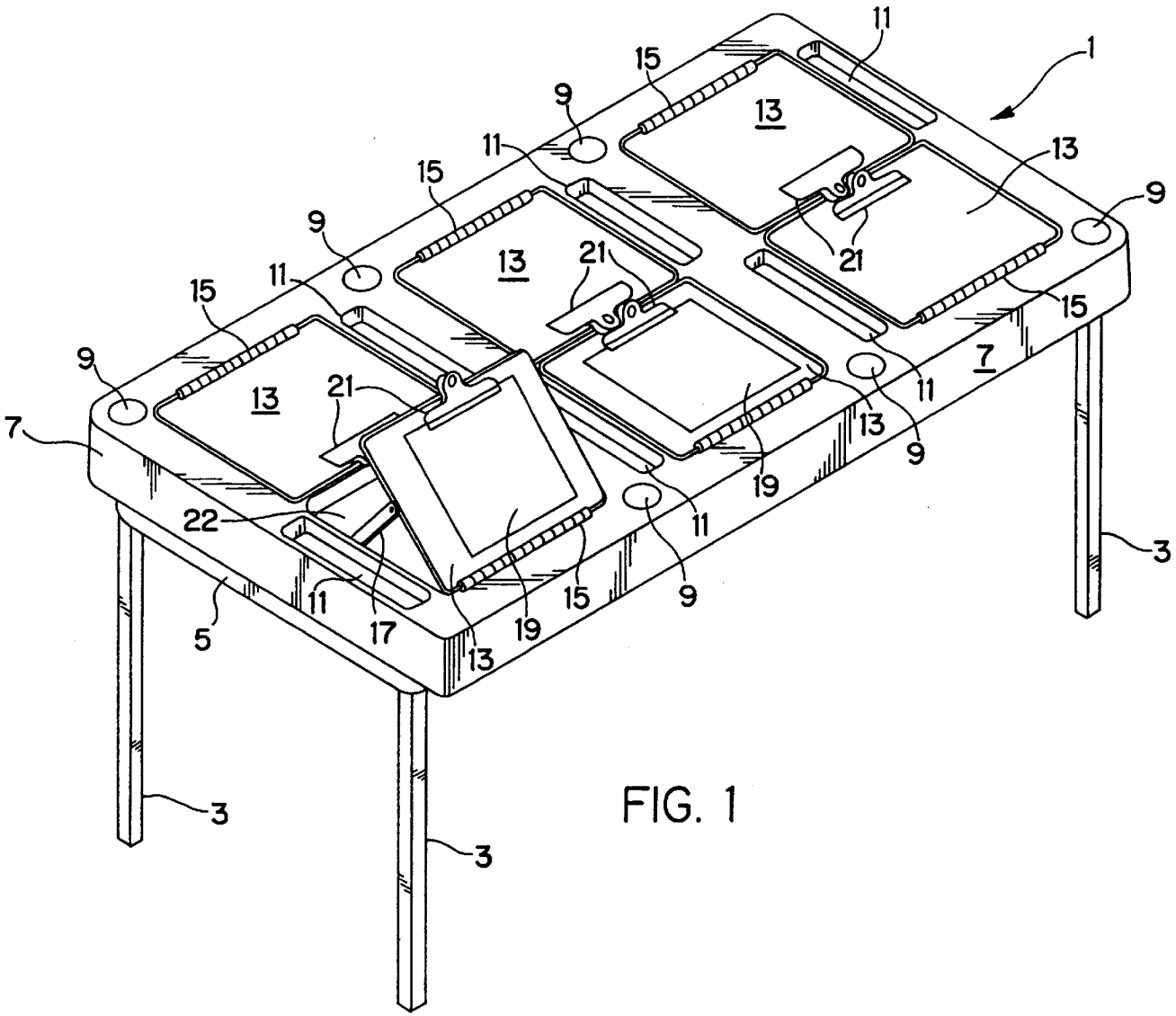
FIG. 1 is a front perspective view of the invention's preferred.
Figure 3:
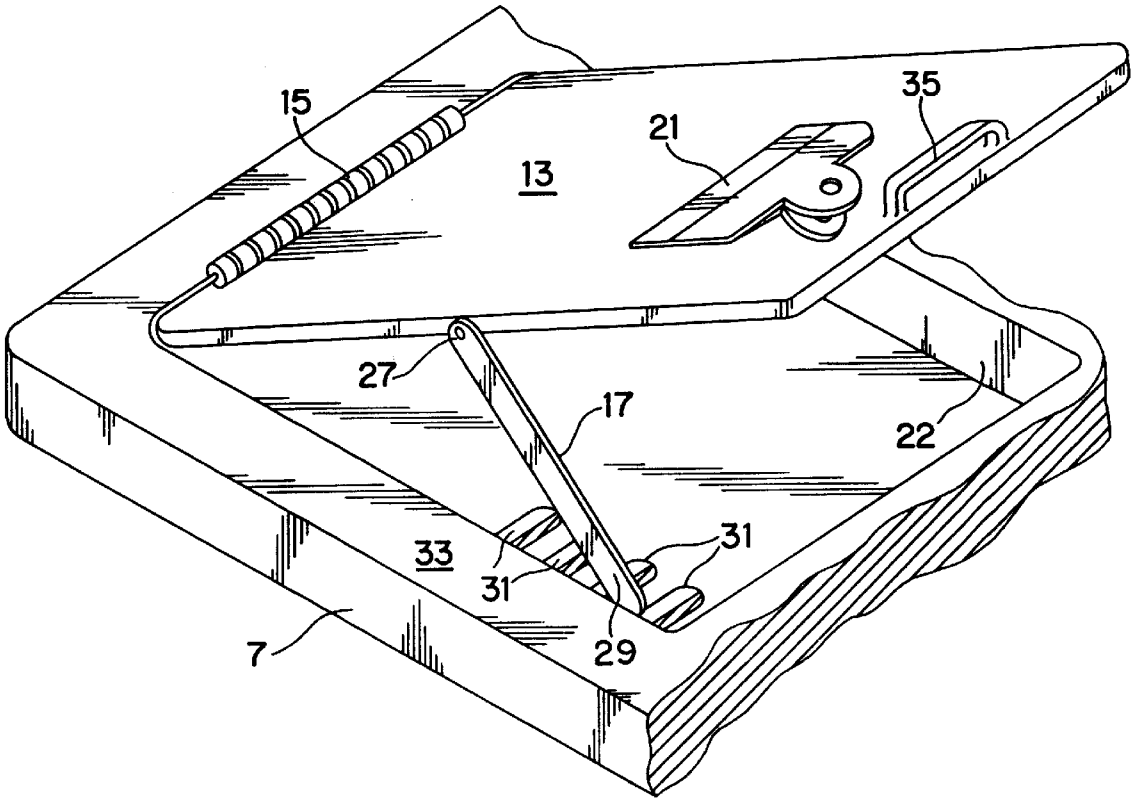
FIG. 3 shows a rear perspective view of the angular orientation adjustment mechanism according to the present invention.
Figure 2:
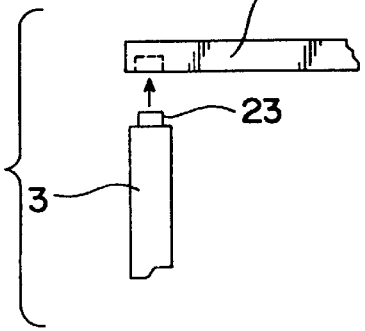
FIG. 2 is a detailed side view showing the mount used in FIG. 1 between the table top and its legs.

FIG. 1 is a front perspective view of the invention's preferred embodiment 1 mounted on four (three shown) spaced parallel supporting lower legs 3. A lower rectangular horizontal planar surface 5, such as a conventional table top, is attached to and supported by the spaced legs at its four end corners. Resting on surface 5 is the main molded plastic planar portion 7 for the table top. On the top surface of planar portion 7 there are six playing stations each with its own indented circular drink holders 9. Also indented into the main planar portion 7 are six elongated rectangular molded-in trays 11 used to hold playing pieces for the game for each player at their station.

Pivoting lower hinged identical card holder boards 13 are located in front of the players in main playing planar portion 7 at each of the six separate playing stations. Each board 13 has a lower edge pivotal hinge connection 15 which permits it to be raised by its opposite edge above the planar portion 7 such that its angular upper surface orientation relative to the planar portion may vary. A side rigid thin elongated support member 17 connected to the side of each board 13 fixes the raised board's angular position relative to the top flat surface of portion 7. One or more playing cards 19, such as bingo cards, may rest flat on the board 13 and be held thereto by upper openable spring fastener clips 21 mounted near the board's free top edge.

Although the present invention's preferred embodiment and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What we claim as our invention is:

1. A bingo table comprising:

a table top having a planar upper surface and a bottom surface;

a plurality of legs downwardly depending from the bottom surface of said table top for supporting the table top a predetermined distance above a supporting surface;

a plurality of receptacles on the upper surface of said table top;

a plurality of substantially planar card holders, each having a first side edge pivotally mounted adjacent a designated receptacle and an opposing free edge which is lifted to place the holder in a desired position;

an elongated support brace attached to each card holder, each brace having first and second ends, the first end pivotally attached to a side edge of one of said card holders with the second end being free;

a plurality of spaced parallel stop members received within each of said receptacles, said stop members spaced to receive the free end of said brace to support the card holder in any one of a plurality of angular positions.

2. A device according to claim 1 wherein said table top further includes a plurality of circular indentions dimensioned to receive a beverage container.

3. A device according to claim 1 wherein said tabletop further comprises:

a plurality of elongated recessed portions for receiving and storing various game tokens associated with bingo.

4. A device according to claim 1 wherein said legs are removably attached to the table top allowing the table to be conveniently dismantled.

5. A device according to claim 1 wherein said card holders include a handle adjacent the free edge thereof which is grasped by a user to lift the free end.

6. A device according to claim 1 further comprising:

a spring biased clip adjacent the free edge of said card holder for retaining a bingo card thereon.

7. A bingo table comprising:

a table top having a planar upper surface and a bottom surface;

a plurality of legs downwardly depending from the bottom surface of said table top for supporting the table top a predetermined distance above a supporting surface;

a plurality of receptacles on the upper surface of said table top;

a plurality of substantially planar card holders, each having a first side edge pivotally mounted adjacent a designated receptacle and an opposing free edge which is lifted to place the holder in a desired position;

a spring-biased clip adjacent the free edge of said card holder for retaining a bingo card thereon;

a locking means for affixing the card holder at the desired position.

8. A bingo table according to claim 7 wherein said locking means comprises:

an elongated support brace attached to each card holder, each brace having first and second ends, the first end pivotally attached to a side edge of one of said card holders with the second end being free;

a plurality of spaced parallel stop members received within each of said receptacles, said stop members spaced to receive the free end of said brace to support the card holder in any one of a plurality of angular positions.

9. A device according to claim 7 wherein said table top further includes a plurality of circular indentions dimensioned to receive a beverage container.

10. A device according to claim 7 wherein said tabletop further comprises:

a plurality of elongated recessed portions for receiving and storing various game tokens associated with bingo.

11. A device according to claim 7 wherein said legs are removably attached to the table top allowing the table to be conveniently dismantled.

12. A device according to claim 7 wherein said card holders include a handle adjacent the free edge thereof which is grasped by a user to lift the free edge.

* * * * *